US007752983B2

(12) United States Patent
Vera

(10) Patent No.: US 7,752,983 B2
(45) Date of Patent: Jul. 13, 2010

(54) METHOD AND APPARATUS FOR PLASMA GASIFICATION OF WASTE MATERIALS

(75) Inventor: Rodrigo B. Vera, Leeds, AL (US)

(73) Assignee: Plasma Waste Recycling, Inc., Huntsville, AL (US)

( * ) Notice: Subject to any disclaimer, the term of this patent is extended or adjusted under 35 U.S.C. 154(b) by 659 days.

(21) Appl. No.: 11/454,366

(22) Filed: Jun. 16, 2006

(65) Prior Publication Data

US 2007/0289509 A1 Dec. 20, 2007

(51) Int. Cl.
*F23G 5/10* (2006.01)
*F23G 5/027* (2006.01)

(52) U.S. Cl. ..... 110/250; 110/346; 110/229

(58) Field of Classification Search ..... 110/250, 110/341, 346, 185
See application file for complete search history.

(56) References Cited

U.S. PATENT DOCUMENTS 4,787,320 A * 11/1988 Raaness et al. ..... 110/250
5,222,448 A 6/1993 Morgenthaler et al.
5,257,586 A * 11/1993 Davenport ..... 110/246
5,319,176 A 6/1994 Alvi et al.
5,451,738 A 9/1995 Alvi et al.
5,534,659 A * 7/1996 Springer et al. ..... 588/311
5,541,386 A 7/1996 Alvi et al.
5,544,597 A 8/1996 Camacho
5,606,925 A 3/1997 Boen et al.
5,634,414 A 6/1997 Camacho
5,648,592 A 7/1997 Pierce
5,666,891 A 9/1997 Titus et al.
5,673,285 A 9/1997 Wittle et al.
5,798,496 A * 8/1998 Eckhoff et al. ..... 219/121.36
5,801,489 A 9/1998 Chism, Jr. et al.
5,886,316 A 3/1999 Pierce
5,958,264 A 9/1999 Tsantrizos et al.
6,018,471 A 1/2000 Titus et al.
6,089,169 A 7/2000 Comiskey
6,127,645 A * 10/2000 Titus et al. ..... 110/250
6,155,182 A 12/2000 Tsangaris et al.
6,160,238 A * 12/2000 Titus et al. ..... 219/121.37
6,222,153 B1 4/2001 Wald (Continued)

FOREIGN PATENT DOCUMENTS

WO WO2004087840 A1 10/2004

*Primary Examiner*—Kenneth B Rinehart
*Assistant Examiner*—David J. Laux
(74) *Attorney, Agent, or Firm*—George P. Kobler; Lanier Ford Shaver & Payne, P.C.

(57) ABSTRACT

A method and apparatus for plasma gasification of waste materials consisting of organic and inorganic portions is provided which includes a refractory-lined reactor vessel, a feeder mechanism, and a DC electrode device. The refractory-lined reactor vessel has a processing chamber formed therein. The feeder mechanism feeds continuously waste materials into the processing chamber at a controlled feed rate. The DC electrode device is used for heating the processing chamber to a sufficient temperature so as to convert the organic portions of the waste materials to a synthetic gas consisting of hydrogen and carbon monoxide and to a carbon particulate, and to convert the inorganic portions of the waste materials to a molten material consisting of a lower metallic layer and a slag layer formed on top of the metallic layer.

16 Claims, 5 Drawing Sheets

U.S. PATENT DOCUMENTS 6,355,904 B1 3/2002 Batdorf et al.
6,466,605 B1 10/2002 Wittle et al.
6,551,563 B1 4/2003 Kado et al.
6,630,113 B1 10/2003 Surma
6,638,396 B1 * 10/2003 Hogan ..... 201/13
6,642,472 B1 11/2003 Hanus
6,763,772 B2 7/2004 Gnedenko et al.
6,781,087 B1 8/2004 Chism, Jr. et al.
6,841,134 B2 1/2005 Hanus et al.
6,971,323 B2 * 12/2005 Capote et al. ..... 110/250
6,987,792 B2 1/2006 Do et al.
2006/0075945 A1 4/2006 Batdorf

* cited by examiner

METHOD AND APPARATUS FOR PLASMA GASIFICATION OF WASTE MATERIALS

BACKGROUND OF THE INVENTION

1. Field of the Invention

This invention relates generally to methods and apparatuses for the treatment of waste materials, and more particularly, the present invention relates to an improved method and apparatus for plasma gasification of hazardous and non-hazardous waste materials by utilizing at least one graphite DC electrode in a refractory lined reactor vessel.

2. Description of the Prior Art

As is generally well known, the daily generation of solid waste material, such as Municipal Solid Waster (MSW) and its disposal thereof, have become major problems in the past few decades as more and more waste is being generated by residential and commercial facilities. The use of landfill sites for the disposal of such MSW does not solve the problems due to all of the existing sites becoming full, coupled with the fact that they contaminate groundwater and adjacent properties. As a result, there are substantial public concerns relative to land space allocation and environmental damage.

In view of this, there have been developed heretofore certain Energy From Waste (EFW) technologies that can provide more efficient and less costly disposal systems by creating energy as a by-product of the destruction process. The most widely known type of EFW facility is incineration in various forms. However, these incinerator EFW systems tend to cause a great deal of air pollution. Consequently, EFW systems based on the gasification process have been developed in the alternative that can produce a lower emission of all environmental contaminants.

For example, in U.S. Pat. No. 5,280,757 to Carter et al., issued on Jan. 25, 1994, there is disclosed a process for treating municipal solid waste that includes feeding, compressing, and forcing a stream of solid waste into the bottom of a reactor vessel heated with a plasma torch.

Further, in U.S. Pat. No. 5,534,659 to Springer et al., issued on Jul. 9, 1996, there is taught a method and apparatus for treating hazardous and non-hazardous waste materials consisting of inorganic and organic components. A plasma arc torch is used to heat a waste processing chamber to a sufficient temperature for converting the organic components of the waste material to a gas and for converting the inorganic components of the waste material to a molten material.

In addition, there is shown in U.S. Pat. No. 6,380,507 to Wayne F. Childs, issued on Apr. 30, 2002, a method and apparatus for processing waste material to produce energy and other reusable materials therefrom which utilizes a plasma arc furnace having at least one hollow electrode. The hollow electrode is projected into a molten pool of material to create the plasma arc to heat the furnace. Waste material is fed through the hollow electrode into the molten pool to ionize and disassociate the waste material.

However, plasma torch-type furnaces are not economical due to the fact that they have to be water cooled, using metallic electrodes that also need to be water cooled. Thus, the plasma torch-type furnaces are inefficient since a substantial amount of the energy that is generated is wasted in the cooling water. Further, the plasma torch arc may radiate in a manner to cause heavy impingement on the refractory-lined walls of the furnace, thereby shortening its useful life. In addition, the plasma torch-type furnaces suffer from the disadvantage of insufficient heating of the bottom of the surface. While a furnace that uses a hollow electrode operates adequately for finely ground or shredded waste materials, it does not perform efficiently with waste products that have not been processed.

Accordingly, it would be desirable to provide an improved method and apparatus for plasma gasification of hazardous and non-hazardous waste materials that is relatively simple and inexpensive in design, construction, and operation. It would also be expedient that the apparatus for plasma gasification of hazardous and non-hazardous waste materials utilizes at least one graphite DC electrode in a refractory-lined reactor vessel so as to allow for a more uniform temperature to be maintained throughout the entire depth of the reactor vessel.

None of the prior art discussed above disclosed an apparatus for plasma gasification of hazardous and non-hazardous waste materials like that of the present invention which includes at least one graphite DC electrode disposed in a molten bath in a refractory-lined reactor vessel. The present invention represents a significant improvement over the aforementioned '757, '659, and '507 prior art patents discussed above.

SUMMARY OF THE INVENTION

Accordingly, it is a general object of the present invention to provide an improved method and apparatus for plasma gasification of hazardous and non-hazardous waste materials which is relatively simple and inexpensive in design, construction, and operation.

It is an object of the present invention to provide an improved method and apparatus for plasma gasification of hazardous and non-hazardous waste materials on a highly efficient and high reliability basis.

It is another object of the present invention to provide an improved method and apparatus for plasma gasification of hazardous and non-hazardous waste materials that utilizes at least one graphite DC electrode in a refractory-lined reactor vessel so as to allow for a more uniform temperature to be maintained throughout the entire depth of the furnace.

It is still another object of the present invention to provide a method and apparatus for plasma gasification of hazardous and non-hazardous waste materials that includes a refractory-lined reactor vessel, a feeder mechanism, and a DC electrode device.

In a preferred embodiment of the present invention, there is provided a method and apparatus for plasma gasification of waste materials consisting of organic and inorganic portions that includes a refractory-lined reactor vessel, a feeder mechanism, and a DC electrode device. The refractory-lined reactor vessel has a processing chamber formed therein. The feeder mechanism continuously feeds waste materials into the processing chamber at a controlled feed rate. The DC electrode device is used for heating the processing chamber to a sufficient temperature so as to convert the organic portions of the waste materials to a synthetic gas consisting of hydrogen and carbon monoxide and to a carbon particulate, and to convert the inorganic portions of the waste materials to a molten material consisting of a lower metallic layer and a slag layer formed on top of the metallic layer.

In one aspect of the present invention, the DC electrode device includes a pair of spaced-apart top graphite anode electrodes extending downwardly from a top end of the reactor vessel and their lower ends thereof being disposed in the molten material, and a conductive plate defining a cathode electrode formed as a portion of a bottom of the reactor vessel and being disposed opposite to the anode electrodes.

In another aspect of the present invention, the feeder mechanism includes a first feeder device for feeding the waste materials directly into the slag layer of the molten material by way of a first extrusion feeder tube formed in a circumferential side wall of the reactor vessel and into an area between the top graphite anode electrodes forming the hottest part of the processing chamber.

BRIEF DESCRIPTION OF THE DRAWINGS

These and other objects and advantages of the present invention will become more fully apparent from the following detailed description when read in conjunction with the accompanying Drawings, with like reference numerals indicating corresponding parts throughout, wherein.

DESCRIPTION OF THE PREFERRED EMBODIMENTS

Figure 1:
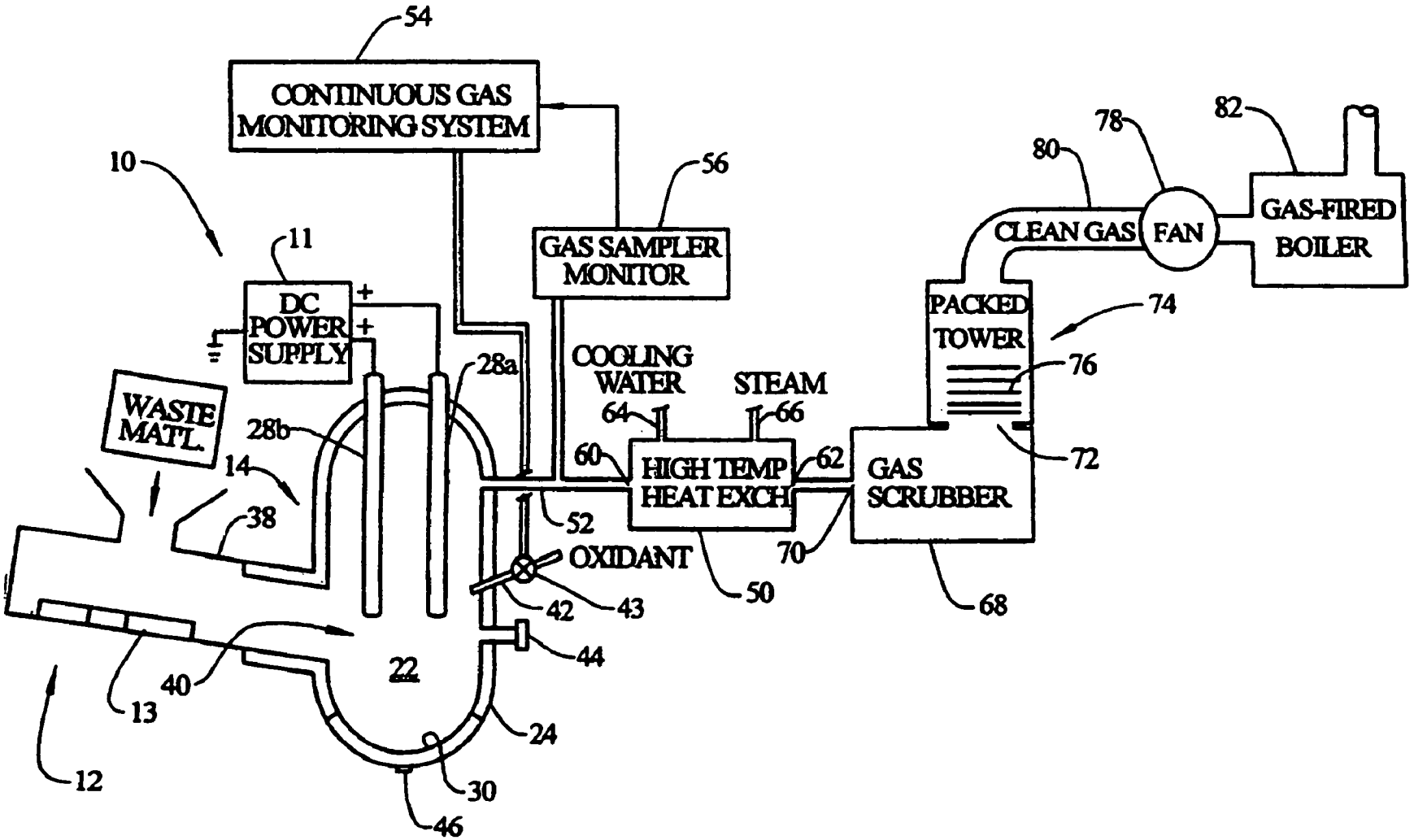
FIG. 1 is a pictorial diagram of an improved apparatus for plasma gasification of hazardous and non-hazardous waste materials, constructed in accordance with the principles of the present invention.

It is to be distinctly understood at the outset that the present invention shown in the drawings and described in detail in conjunction with the preferred embodiments is not intended to serve as a limitation upon the scope or teachings thereof, but is to be considered merely as an exemplification of the principles of the present invention.

Referring now in detail to the drawings, there is illustrated in FIG. 1 a pictorial diagram of an apparatus 10 for plasma gasification of hazardous and non-hazardous waste materials contained in organic and inorganic products, constructed in accordance with the principles of the present invention. The apparatus 10 includes an electrical power supply network 11, a waste feeder system 12, and a refractory-lined reactor vessel 14. The waste feeder system 12 is provided for feeding the hazardous and non-hazardous waste materials consisting of organic and inorganic components into the refractory-lined reactor vessel 14 at a controlled rate. The waste feeder system feeds a stream of shredded and compact waste materials into the reactor vessel in a continuous manner. The hazardous and non-hazardous waste materials may include, but are not limited to, municipal solid waste (MSW), medical type waste, radioactive contaminated waste, agricultural waste, pharmaceutical waste, and the like.

The waste feeder system 12 includes a conventional hydraulic type compactor/extruder feeder mechanism 13 in order to prepare and deliver the waste material for delivery into the reactor vessel 14. Alternatively, the feeder system may consist of a conveyor screw or auger type feeder driven by a motor for shredding, mixing, compressing, and extruding the waste materials. The waste materials are delivered into the reactor vessel at a controlled rate so as to expose a predetermined amount of compacted waste to the thermal decomposition (pyrolysis) process for regulating the formation of product synthesis gases (syngas). The feed rate is dependent upon the characteristics of the waste materials as well as the temperature and oxygen conditions within the reactor vessel.

The electrical power supply network 11 includes a single DC power supply that generates a high voltage with a normal operating range of about 300 to 1,000 VDC. Alternatively, the power supply network may consist of two separate DC power supplies, each being used to supply one-half of the operating voltage and current. Inside of the reactor vessel 14, a high temperature plasma arc generates temperatures in excess of 2,900 degrees F. so that, upon entry of the waste stream, it is immediately dissociated with the organic portion of the waste material being converted to carbon and hydrogen and the inorganic portion and metals of the waste material melted with the metal oxides being reduced to metal. One or more top DC graphite electrodes 28 and a conductive plate defining a cathode electrode 30 formed in the bottom of the reactor vessel is connected to the single DC power supply 11 equipped with means for varying the current flow so as to create the high temperature plasma arc, as will be more fully described below. Alternatively, when two separate DC power supplies are used, each one is connected to one of the top electrodes and the bottom cathode electrode.

Figure 2:
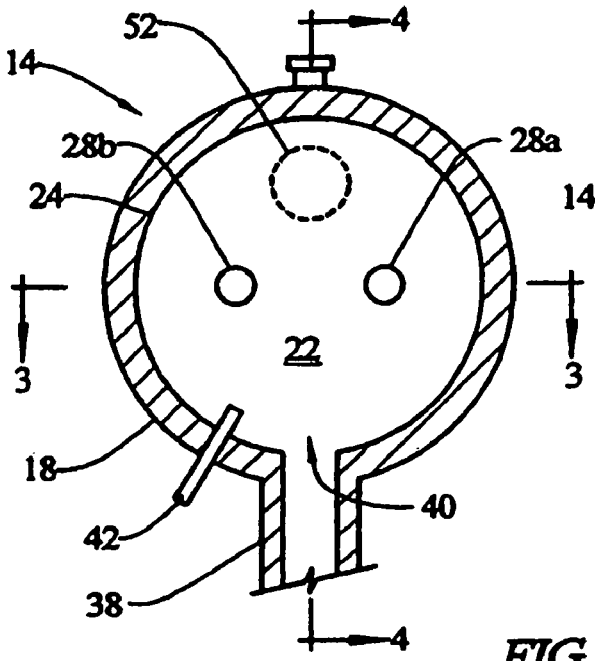
FIG. 2 is a cross-sectional view of a refractory-lined reactor vessel for use in the apparatus of FIG. 1, illustrating dual graphite electrodes.
Figure 4:
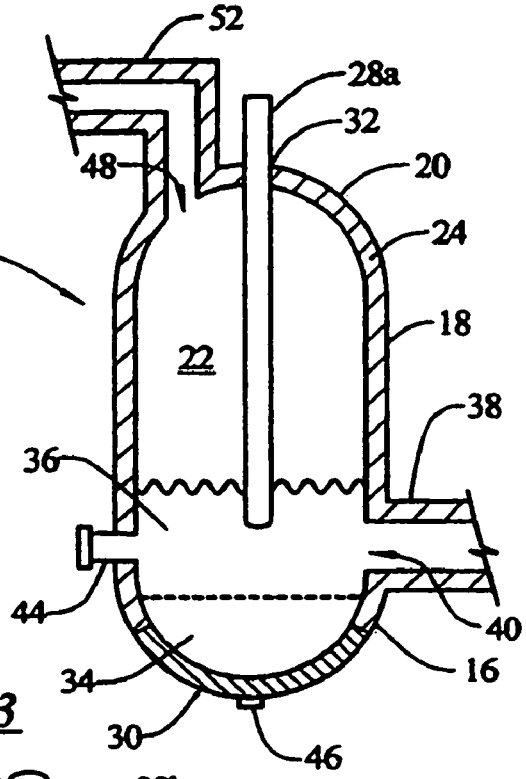
FIG. 4 is a cross-sectional view of the reactor vessel of FIG. 2, taken along the lines 4-4 thereof.
Figure 3:
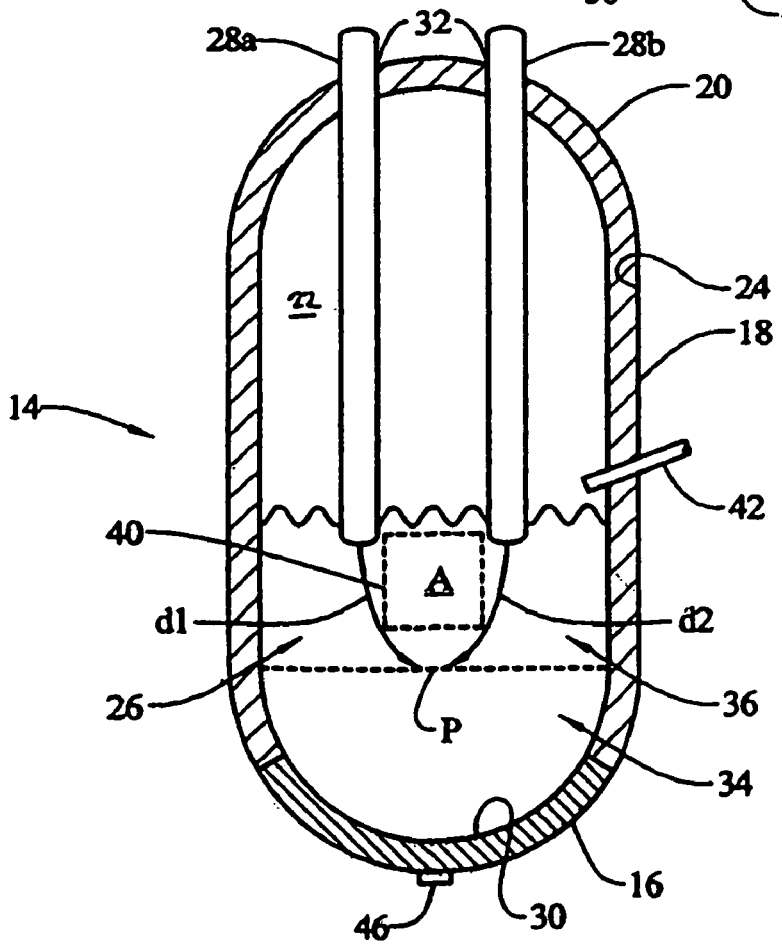
FIG. 3 is a cross-sectional view of the reactor vessel of FIG. 2, taken along the lines 3-3 thereof.

With reference to FIG. 2, there is shown a cross-sectional view of the refractory-lined reactor vessel 14 for use in the apparatus of FIG. 1. FIG. 3 is a cross-sectional view of the reactor vessel 14, taken along the lines 3-3 thereof. FIG. 4 is a cross-sectional view of the reactor vessel 14, taken along the lines 4-4 thereof. The reactor vessel 14 has a generally cylindrical shape and is preferably vertically oriented as illustrated with a height dimension of approximately twenty to forty feet and a diameter of about of ten to twenty feet. However, it should be understood that various other cross-sectional configurations, such as square, rectangle, oval, and the like, may be used as well.

The reactor vessel 14 is formed by a generally semi-spherical closed bottom 16 and a circumferential side wall 18 which extends upwardly from the closed bottom 16 and terminates in a generally semi-spherical upper end 20 so as to create a processing chamber 22 therein. The bottom 16, the side wall 18, and the upper end of the reactor vessel 14 is provided with a refractory lining 24 having a thickness of about thirty-six to forty-eight inches so as to withstand temperatures of up to approximately 1850 degrees C. in a reducing environment. It should be noted that the shape and the dimensions thereof are supplied for illustrative purposes and may be varied considerably provided that the essential features, function, and attributes of the present invention described herein are not sacrificed.

The bottom 16 of the reactor vessel 14 defines a hearth for receiving a molten metal bed or bath 26 which is heated by a pair of spaced-apart DC graphite electrodes 28*a*, 28*b* of the same polarity (anodes) and a conductive plate defining a cathode electrode 30 operatively connected to the DC power supply 11. The anode electrodes 28*a*, 28*b* extend downwardly through openings 32 formed in the upper end 20 of the reactor vessel with their lower ends thereof being submerged in the molten bath 26. The cathode electrode 30 is mounted to and forms a portion of the bottom 16 of the reactor vessel, facing opposite to the anode electrodes. Alternatively, it should be understood by those skilled in the art that a single cathode electrode may be formed in the center of the bottom 16 of the reactor vessel, or multiple pins may be spaced uniformly throughout the bottom 16 of the reactor vessel in lieu of using the conductive plate as illustrated.

The single DC power supply network 11 produces an electrical current to flow between each one of the two top graphite anode electrodes 28*a*, 28*b* and the cathode electrode 30 in the bottom 16 of the reactor vessel. The electric power is supplied in such a way to produce a long plasma arc discharge extending into the molten bed 26 contained in the hearth so as to allow for the temperature to be maintained uniformly throughout the entire depth of the molten bed when the present invention is in operation, as herein further described below. The area A between the two top electrodes 28*a*, 28*b* defines a location where exceptionally high temperature and energy levels exist. This is due not only to the arc discharges d1 and d2 between the two top electrodes and the bottom cathode electrode, but also from the arc discharges converging towards a point P located between the top electrodes.

As can be best seen from FIGS. 3 and 4, during operation, the molten bath 26 filling the bottom 16 of the reactor vessel 14 will be separated into a bottom metal (iron) layer 34 and an inorganic "foamy" or "gassy" slag layer 36. It will be noted that the lower ends of the two top electrodes 28*a*, 28*b* are preferably submerged into the slag layer 36. Alternately, the lower ends of the electrodes may be disposed to be slightly above the slag layer. The waste materials are fed into the vessel 14 via a feeder extrusion tube 38 and a rectangular-shaped opening 40 having approximate dimensions of six feet in width and four feet in height formed in its side wall 18 thereof. By injecting the waste materials directly into the slag layer 36 of the molten bath 26 between the two top electrodes, the waste materials are immediately subjected to very high temperatures, i.e., above 2900 degrees F., that completely disassociates the waste materials.

The organic portion of the waste material will disassociate into the synthetic gas consisting of a carbon and hydrogen mixture. The inorganic portion of the waste material will be melted with the metal oxides and will be reduced to a metal, which is accumulated at the bottom of the molten bath. All of the inorganic compounds will form the vitreous slag layer 36 disposed above the metal layer 34. The carbon formed in such plasma gasification process will float to the surface and will be combined with the oxygen being injected so as to form carbon monoxide. This is achieved by multiple oxygen and/or steam injection ports, such as injection port 42, located in the side wall 18 of the reactor vessel 14 above the slag layer. The injection port 42 supplies oxygen in the form of steam or as oxygen gas, within the processing chamber 22, so as to maintain the appropriate concentration of oxygen in the reactor vessel at all times and thus maintaining the reducing atmosphere and regulating the products of the pyrolysis.

In the lower portion of the processing chamber 22, there is provided a vitreous slag tap 44 which is made of a suitable diameter so as to permit overflow tapping of the glassy slag. Metal residue, if any, can be accumulated and be tapped through a bottom tap 46 so as to allow the processing chamber to be emptied. In a continuous operation, the slag and metal materials are tapped periodically without the necessity of turning off the vessel. Lime or other additives may be added to improve the vitrification, capturing of the halogens, and/or producing a desired chemical balance within the vessel.

A gas vent or duct 48 is also provided in the upper end 20 of the reactor vessel, which is designed to convey the produced syngas at a temperature of about 875 to 1,000 degrees C. to a high temperature heat exchanger 50 (FIG. 1) via a gas pipe 52. The gas pipe 52 has a diameter to control the gas exiting velocity in order to minimize particulate entrapment and to maximize the efficiency of the plasma gasification.

With reference back to FIG. 1 of the drawings, the process of the present invention for converting the mixture of organic and inorganic portions of the waste materials into the vitreous slag and the synthetic gases (syngas) will now be explained. Initially, it should be understood that the present process has particular applications for the destruction of a wide variety of waste materials as well as for use in such industrial processes as coal gasification or the gasification of other waste materials. As the waste materials are delivered into the processing chamber 22 of the reactor vessel 14 by the feeder mechanism 13, the waste materials will absorb energy by convection, conduction, and radiation from the long plasma arc discharges generated, the hot vitrous slag, the heated refractory lining 24, and the heated gases circulating within the processing chamber 22. As the organic portion of the waste materials is heated, it becomes increasingly unstable until it eventually disassociates into its elemental components consisting mainly of carbon and hydrogen.

The removal of unwanted air from the process is critically important since the presence of air, which is almost 80 percent nitrogen, will dilute the syngas being generated and unnecessarily cool the process. The exclusion of air is also vital to maintaining the gasification rate, peak efficiency, and chemical quality since nitrogen can act as a heat sink within the processing chamber so as to cause loss of valuable heat energy. Furthermore, it is of utmost importance to expose the organic portion to be gasified as quickly as possible to sufficiently high temperatures so that disassociation will occur without the formation of intermediate compounds interfering with the chemical purity desired.

As a result, the feeder system 12 is designed to ensure that all extraneous air is removed from the waste materials prior to its delivery into the processing chamber 22. In addition, the waste materials are fed directly into the central portion of the frothy slag layer 36 of the molten material 26 by way of the feeder extrusion tube 38 formed in the side wall 18 of the reactor vessel 14 and into the area A between the two top electrodes 28*a*, 28*b*, which is the hottest part of the processing chamber. Alternatively, the feeder mechanism 13 may load the waste materials into an area just above the slag layer 36, thereby allowing the waste to drop and sink into the slag layer. Also, as another alternative, the waste can be introduced directly into the bottom metal layer 34 under the slag layer 36.

The high temperature plasma in the area A between the top electrodes produces temperatures in excess of 2,900 degrees F. so that the disassociation of the molecules comprising the waste materials will occur immediately. The solid top anode electrodes 28*a*, 28*b* and the bottom cathode electrode 30 are operatively connected to the single DC power supply 11 so as to produce the plasma arc discharges. Alternatively, the top and bottom electrodes 28*a*, 30 can be suitably connected to a first separate DC power, and the top and bottom electrodes 28*b*, 30 can be suitably connected to a second separate DC power supply. The apparatus 10 in accordance with the present invention is capable of processing approximately 30 tons per hour of waste, using a 10 to 15 Megawatt-hour power supply.

The syngas expands rapidly and flows from the processing chamber 22 to the gas pipe 52 via the gas vent or outlet 48, carrying with it a portion of any fine carbon particulate generated by the disassociation of the waste. The process is designed to deliver the syngas at a temperature of about 875 to 1,100 degrees C. to the heat exchanger 50. The gas pipe 52 is designed to be airtight so as to prevent the syngas from escaping or allowing atmospheric air to enter. The gas pipe 52 is also preferably refractory lined in order to maintain the effective temperature of the syngas above 875 degrees C. to substantially prevent the formation of complex organic components and to recover as much of the latent gas enthalpy as possible. The injector 42 supplies preferably the oxygen gas to the processing chamber so as to maintain the appropriate concentration at all times and thus maintaining a reducing environment in order to regulate the product of pyrolysis.

The waste conversion process is designed to minimize surges of carbon particulates during the pyrolysis process. The apparatus 10 includes a continuous gas monitoring system 54 defining a control or regulating means that processes variables that are subsequently used to control automatically the optimum waste feed rate, steam/oxygen injection, and other process variables to achieve the most efficient gasification of waste material. The process is designed to control the reformation of the organic components from the separated elemental components. This is achieved generally by regulating not only the various temperatures and pressures, but also by controlling the amount of oxygen that is injected into the processing chamber. As a consequence, any excess carbon is gasified to provide a maximum percentage of hydrogen and carbon monoxide (CO) and minimum percentage of carbon dioxide ($CO_2$), carbon particulate, and reformed complex organic compounds in the product syngas.

Since the amount of oxygen liberated from the waste materials is normally insufficient to convert all of the solid carbon to carbon monoxide gas, fine carbon particulate will be entrained and carried out of the processing chamber 22 by the hydrogen dominated product gas. As a result, an additional source of oxygen is typically required to optimize the conversion process. Thus, an oxygen or steam supply source (not shown) comprised of a steam/oxygen generator and steam/oxygen valve 43 is opened in a controlled manner to supply steam/oxygen to the injector 42, which injects predetermined amounts of steam/oxygen into the processing chamber 22 so as to convert a major part of the carbon particulate to carbon monoxide.

The proper amount of steam/oxygen injected is determined by a gas sample monitor 56 located adjacent to the gas pipe 52, which measures the percentages of hydrogen, carbon monoxide, carbon dioxide, particulate matter, and methane in the product gas as it leaves the processing chamber. The gas sampler monitor 56 includes a detector (not shown) which continuously monitors the product gas exiting the processing chamber. If the detector senses a large percentage of carbon dioxide, it causes the continuous gas monitor system 54 to reduce the opening of the steam/oxygen valve 43 so as to decrease the amount of steam/oxygen injected. On the other hand, if the detector senses an increased percentage of particulate matter, it causes the system 54 to enlarge the opening of the steam/oxygen valve 43 so as to increase the amount of steam/oxygen injected until an acceptable level of carbon dioxide is reached.

The product syngas in the gas pipe 52 containing carbon monoxide is passed as an off-gas to means for cooling the product gas to a temperature below about 150 degrees C. and for separating a portion of the entrained carbon particulate from the product gas. The cooling means is preferably a high temperature heat exchanger 50 having its inlet 60 connected directly to the gas pipe 52 and an outlet 62. A cold water intake line 64 is provided to deliver cooling water to the heat exchanger 50. As the water is heated and turned to steam, the steam produced is then passed out through a high pressure steam outlet 66. The hot gases may be then delivered to a cold water quencher (not shown) for rapid cooling. As the product off-gas contacts the cooling water, it is quickly heated, and evaporative cooling quickly cools the temperature of the product gas so as to prevent the reformation of complex organic molecules. The cooling water also serves to remove a portion of the carbon and metal particulate entrained in the product off-gas.

After the product off-gas exits the outlet 62 of the heat exchanger 58 and is subsequently cooled by the quencher, it is then delivered into a means for neutralizing acidic gas in the cooled product off-gas and for separating substantially the remaining portion of the carbon particulate therefrom so as to form the product clean gas. This neutralizing means is preferably a dry or wet gas scrubber 68 having its inlet 70 connected directly to the outlet of the heat exchanger 50 and an outlet 72. In the processing chamber 22 of the reactor vessel, the halogenated materials and other organic waste decompose and, in the hydrogen rich gas, will be reformed as hydrochloric and other acidic gases. This compound is neutralized in the gas scrubber 68 by reacting it with a basic neutralizing agent in order to form salts, as the cooled product off-gas passes therethrough.

Next, the scrubbed gas is transported to a packed tower 74 that includes means for removing entrained moisture so to ensure as dry as possible the product clean gas. The packed tower includes baffles and a series of condenser evaporator coils 76. A draft fan 78 with a damper or any other means for creating a draft such as a wet Venturi is used to draw the product clean gas through an exiting pipe 80 to a downstream energy recovery equipment, such as a commercial gas-fired boiler or thermal oxidizer 82. The product clean gas formed from the conversion of organic materials in the waste materials is mainly hydrogen and carbon monoxide. This composition of gas has fuel value and can be used to recover the energy that was in the waste materials, thereby improving significantly the economics of the conversion process.

Figure 5:
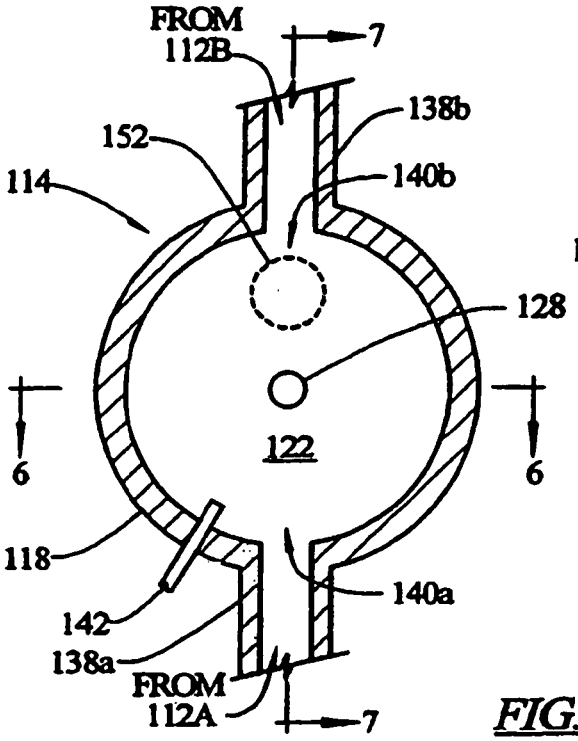
FIG. 5 is a cross-sectional view of a second embodiment of a refractory-lined reactor vessel for use in the apparatus of FIG. 1, illustrating a single graphite electrode.
Figure 7:
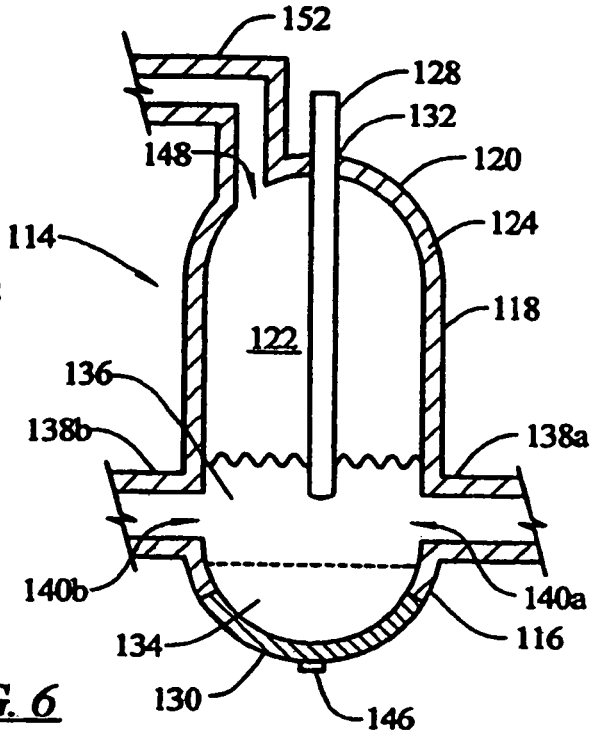
FIG. 7 is a cross-sectional view of the reactor vessel of FIG. 5, taken along the lines 7-7 thereof.
Figure 6:
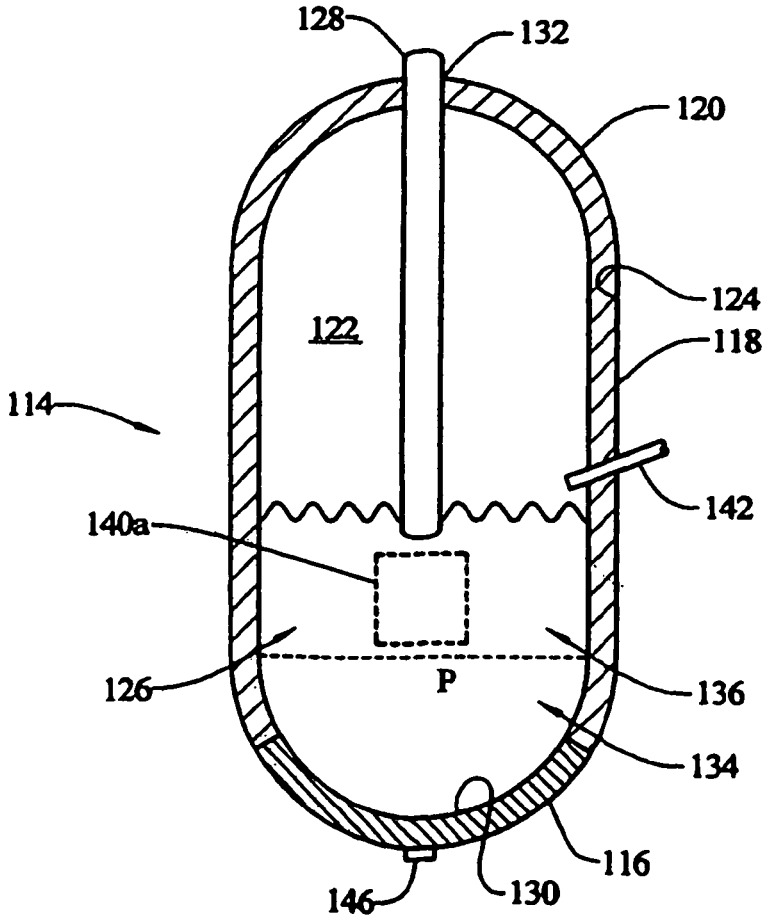
FIG. 6 is a cross-sectional view of the reactor vessel of FIG. 5, taken along the lines 6-6 thereof.

In FIG. 5, there is shown a cross-sectional view of a second embodiment of a refractory-lined vessel 114 of the present invention for use in the apparatus of FIG. 1. FIG. 6 is a cross-sectional view of the reactor vessel 114 of FIG. 5, taken along the lines 6-6 thereof. FIG. 7 is a cross-sectional view of the reactor vessel 114 of FIG. 5, taken along the lines 7-7 thereof. The reactor vessel 114 is substantially identical to the reactor vessel 14 of FIGS. 2 and 4, except that there is provided two feeder mechanisms and only a single anode electrode. Except for these differences, the structure and operation of the reactor vessel 114 is identical to the reactor vessel 14.

The reactor vessel 114 has the same shape and dimensions as the reactor vessel 14 illustrated in FIGS. 2-4. In particular, the reactor vessel 114 is formed by a generally semi-spherical closed bottom 116 and a circumferential side wall 118 that extends upwardly from the closed bottom 116 and terminates in a generally semi-spherical upper end 120 so as to create a processing chamber 122 therein. The bottom 116, the side wall 118, and the upper end 120 of the reactor vessel 114 is provided with a refractory lining 124 having a thickness of about thirty-six to forty-eight inches so as to withstand temperatures of up to approximately 1850 degrees C. in a reducing environment.

The bottom 116 of the reactor vessel 114 defines a hearth for receiving a molten metal bed or bath 126 that is heated by a single DC graphite electrodes 128 of one polarity (anode) and a conductive plate defining a cathode electrode 130 operatively connected to the DC power supply 11. The anode electrode 128 extends downwardly through opening 132 formed in the central portion of the upper end 120 of the reactor vessel 114 with its lower end thereof being submerged in the molten bath 126. The cathode electrode 130 is mounted to and forms a portion of the bottom 116 of the reactor vessel. Alternatively, it should be understood by those skilled in the art that a single cathode electrode may be formed in the center of the bottom 116 of the reactor vessel, or multiple pins may be spaced uniformly throughout the bottom 116 of the reactor vessel in lieu of using the conductive plate as illustrated.

The DC power supply network 11 produces an electrical current to flow between the top graphite anode electrode 128 and the cathode electrode 130 in the bottom 116 of the reactor vessel. The waste material is fed into the reactor vessel 114 by a pair of feeder mechanisms 112*a* and 112*b* via the corresponding extrusion feeder tubes 138*a*, 138*b* disposed on opposite sides of the anode electrode 128.

Figure 8:
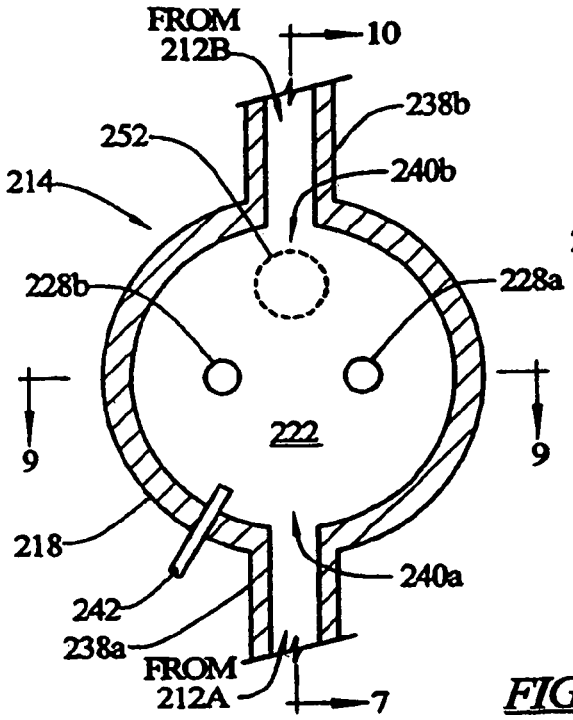
FIG. 8 is a cross-sectional view of a third embodiment of a reactor vessel for use in the apparatus of FIG. 1, illustrating dual graphite electrodes and two feeder mechanisms disposed on opposite sides thereof.
Figure 10:
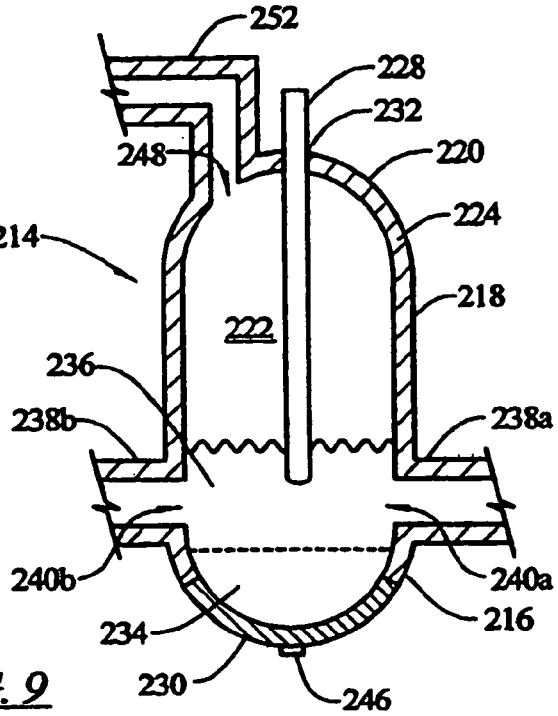
FIG. 10 is a cross-sectional view of the reactor vessel of FIG. 8, taken along the lines 10-10 thereof.
Figure 9:
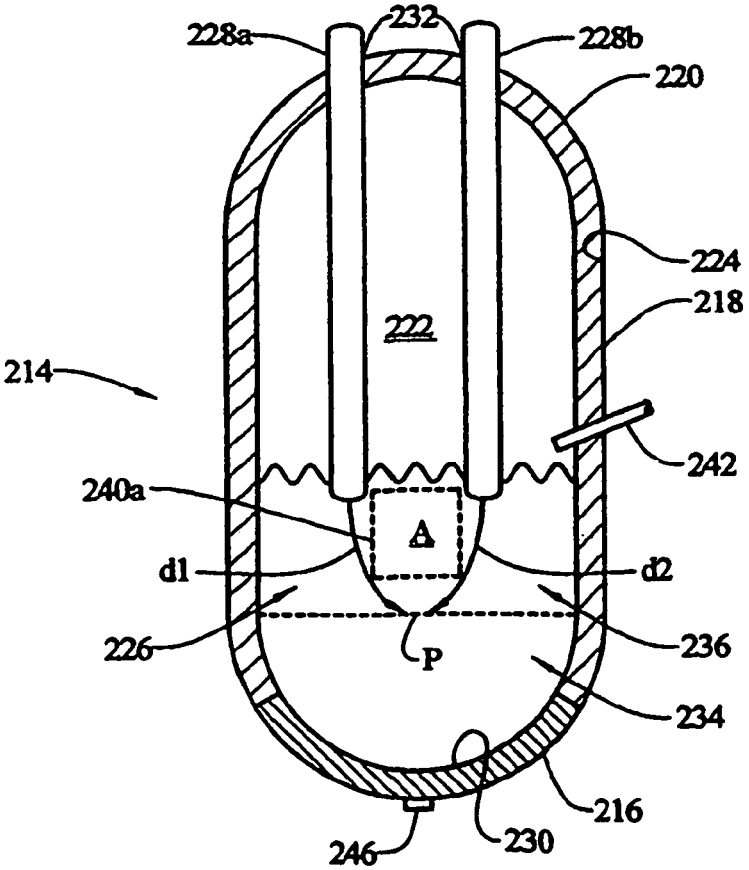
FIG. 9 is a cross-sectional view of the reactor vessel of FIG. 8, taken along the lines 9-9 thereof.

In FIG. 8, there is shown a cross-sectional view of a third embodiment of a refractory-lined vessel 214 of the present invention for use in the apparatus of FIG. 1. FIG. 9 is a cross-sectional view of the reactor vessel 214 of FIG. 8, taken along the lines 9-9 thereof. FIG. 10 is a cross-sectional view of the reactor vessel 214 of FIG. 8, taken along the lines 10-10 thereof. The reactor vessel 214 is substantially identical to the reactor vessel 14 of FIGS. 2-4, except that there is provided two feeder mechanisms. Except for this difference, the structure and operation of the reactor vessel 214 is identical to the reactor vessel 14.

The reactor vessel 214 has the same shape and dimensions as the reactor vessel 14 illustrated in FIGS. 2-4. In particular, the reactor vessel 214 is formed by a generally semi-spherical closed bottom 216 and a circumferential side wall 218 that extends upwardly from the closed bottom 216 and terminates in a generally semi-spherical upper end 220 so as to create a processing chamber 222 therein. The bottom 216, the side wall 218, and the upper end 220 of the reactor vessel 214 is provided with a refractory lining 224 having a thickness of about thirty-six to forty-eight inches so as to withstand temperatures of up to approximately 1850 degrees C. in a reducing environment.

The bottom 216 of the reactor vessel 214 defines a hearth for receiving a molten metal bed or bath 226 which is heated by a pair of spaced-apart DC graphite electrodes 228*a*, 228*b* of the same polarity (anodes) and a conductive plate defining a cathode electrode 230 operatively connected to the DC power supply 11. The anode electrodes 228*a*, 228*b* extend downwardly through openings 232 formed in the upper end 220 of the reactor vessel 214, with their lower ends thereof being submerged in the molten bath 126. The cathode electrode 230 is mounted to and forms a portion of the bottom 216 of the reactor vessel. Alternatively, it should be understood by those skilled in the art that a single cathode electrode may be formed in the center of the bottom 216 of the reactor vessel, or multiple pins may be spaced uniformly throughout the bottom 216 of the reactor vessel in lieu of using the conductive plate as illustrated.

The DC power supply network 11 produces an electrical current to flow between each one of the two top graphite anode electrodes 228*a*, 228*b* and the bottom cathode electrode 230. The waste material W is fed into the reactor vessel 114 by a pair of feeder mechanisms 212*a* and 212*b* via the corresponding extrusion feeder tubes 238*a*, 238*b* disposed between the anode electrodes 228*a*, 228*b* and on opposite sides thereof.

Figure 11:
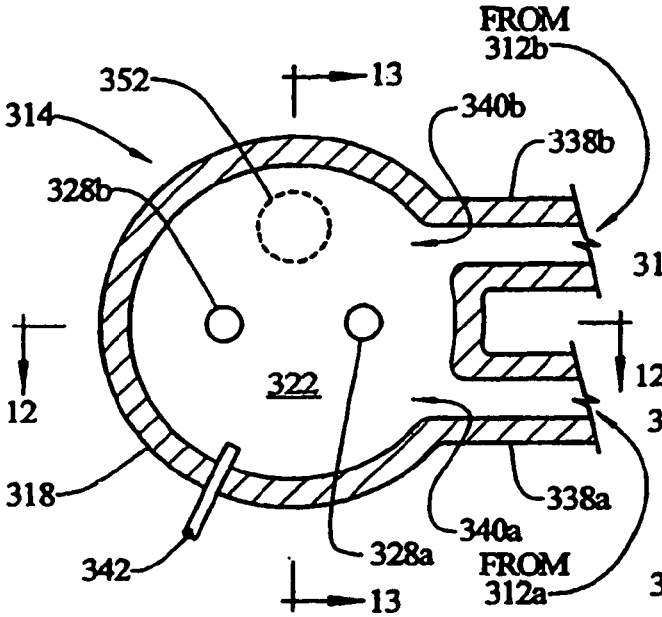
FIG. 11 is a cross-sectional view of a fourth embodiment of a refractory-lined reactor vessel for use in the apparatus of FIG. 1, illustrating dual graphite electrodes and two feeder mechanisms disposed on the each side of the electrodes.
Figure 13:
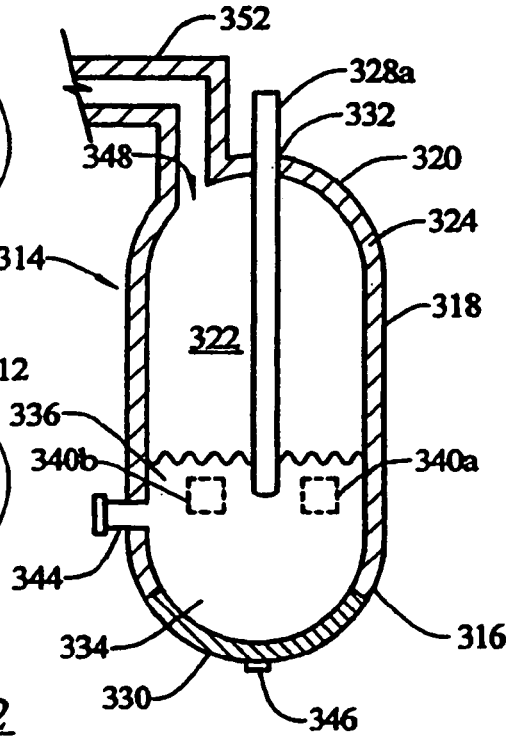
FIG. 13 is a cross-sectional view of the reactor vessel of FIG. 11, taken along the lines 13-13 thereof.
Figure 12:
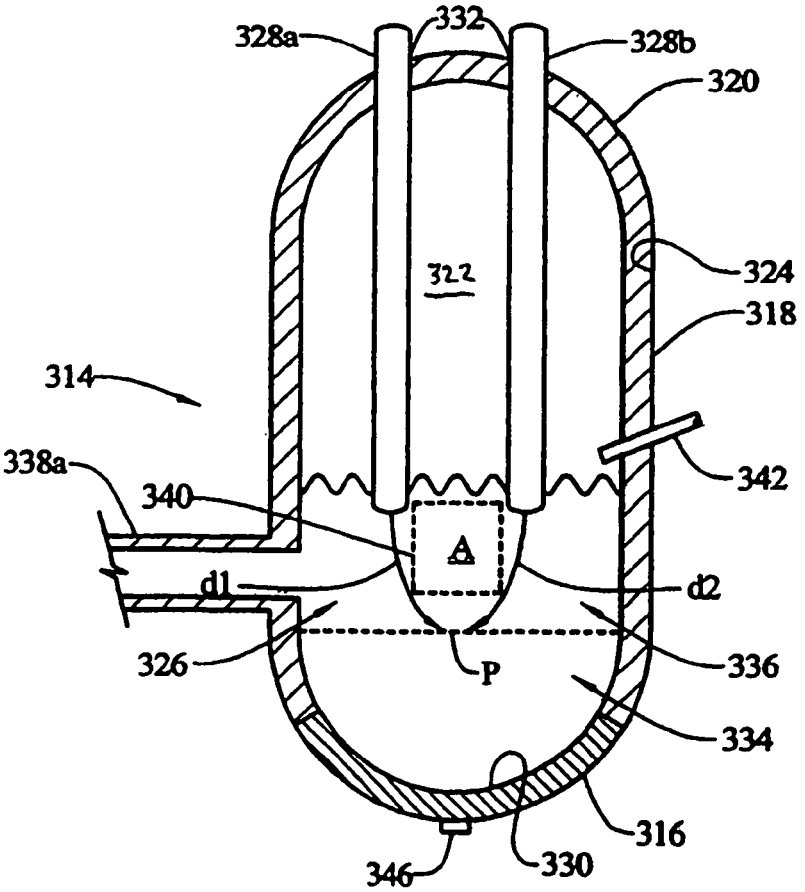
FIG. 12 is a cross-sectional view of the reactor vessel of FIG. 11, taken along the lines 12-12 thereof.

In FIG. 11, there is shown a cross-sectional view of a fourth embodiment of a refractory-lined vessel 314 of the present invention for use in the apparatus of FIG. 1. FIG. 12 is a cross-sectional view of the reactor vessel 314 of FIG. 11, taken along the lines 12-12 thereof. FIG. 13 is a cross-sectional view of the reactor vessel 314 of FIG. 11, taken along the lines 13-13 thereof. The reactor vessel 314 is substantially identical to the reactor vessel 14 of FIGS. 2-4, except that there is provided two feeder mechanisms. Except for this difference, the structure and operation of the reactor vessel 314 is identical to the reactor vessel 14.

The reactor vessel 314 has the same shape and dimensions as the reactor vessel 14 illustrated in FIGS. 2-4. In particular, the reactor vessel 314 is formed by a generally semi-spherical closed bottom 316 and a circumferential side wall 318 which extends upwardly from the closed bottom 316 and terminates in a generally semi-spherical upper end 320 so as to create a processing chamber 322 therein. The bottom 316, the side wall 318, and the upper end 120 of the reactor vessel 314 is provided with a refractory lining 324 having a thickness of about thirty-six to forty-eight inches so as to withstand temperatures of up to approximately 1850 degrees C. in a reducing environment.

The bottom 316 of the reactor vessel 314 defines a hearth for receiving a molten metal bed or bath 326 which is heated by a pair of spaced-apart DC graphite electrodes 328*a*, 328*b* of the same polarity (anode) and a conductive plate defining a cathode electrode 330 operatively connected to the DC power supply 11. The anode electrodes 328*a*, 328*b* extend downwardly through openings 332 formed in the upper end 320 of the reactor vessel 314, with their lower ends thereof being submerged in the molten bath 326. The cathode electrode 330 is mounted to and forms a portion of the bottom 316 of the reactor vessel. Alternatively, it should be understood by those skilled in the art that a single cathode electrode may be formed in the center of the bottom 316 of the reactor vessel, or multiple pins may be spaced uniformly throughout the bottom 316 of the reactor vessel in lieu of using the conductive plate as illustrated.

The DC power supply network 11 produces an electrical current to flow between each one the two top graphite anode electrodes 328*a*, 328*b* and the bottom cathode electrode 330. The waste material W is fed into the reactor vessel 314 by a pair of adjacent spaced-apart feeder mechanisms 312*a* and 312*b* via the corresponding extrusion feeder tubes 338*a*, 338*b* disposed on opposite sides of the anode electrodes 328*a*, 328*b*.

From the foregoing detailed description, it can thus be seen that the present invention provides a method and apparatus for plasma gasification of hazardous and non-hazardous waste materials that includes a refractory-lined reactor vessel, a feeder mechanism, and a DC electrode device. The DC electrode device includes a pair of spaced-apart top graphite anode electrodes extending downwardly from a top end of the reactor vessel, and their lower ends thereof being submerged in the molten material, and a conductive plate defining a cathode electrode formed as a portion of a bottom of the reactor vessel and being disposed opposite to the anode electrodes. As a result, there is maintained a more uniform temperature throughout the entire depth of the molten material.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

The invention claimed is:

1. An apparatus for plasma gasification of waste materials consisting of organic and inorganic portions comprising:

a refractory-lined reactor vessel having a processing chamber formed therein;

a DC electrode system having top and bottom DC electrodes, said top electrode extending downwardly from the top of said chamber and said bottom electrode located on the bottom of said chamber, for generating a plasma arc and heating said processing chamber to a sufficient temperature so as to convert the organic portions of the waste materials to a synthetic gas consisting of hydrogen and carbon monoxide and to a carbon particulate, and to convert the inorganic portions of the waste materials to a molten material within said chamber consisting of a lower metallic layer and a slag layer formed on top of the metallic layer, wherein a lower end of said top electrode is submerged below the surface of said slag layer such that both said top and bottom electrodes are in direct contact with said molten material and said plasma arc occurs entirely within the molten material; and a feeder mechanism in communication with an opening defined in a wall of said reactor vessel processing chamber for the introduction of said waste materials into said chamber, said opening occurring in said wall at a height proximal to a lower end of said top electrode.

2. An apparatus for plasma gasification of waste materials as claimed in claim 1, wherein said DC electrode system includes a pair of spaced-apart top graphite electrodes and a conductive plate defining an electrode formed as a portion of a bottom of said reactor vessel and being disposed opposite to a corresponding one of said top electrodes.

3. An apparatus for plasma gasification of waste materials as claimed in claim 1, wherein said DC electrode system includes a pair of spaced-apart top graphite electrodes and a bottom of said reactor vessel being made of a conductive material so as to function as a counter electrode.

4. An apparatus for plasma gasification of waste materials as claimed in claim 1, further comprising a second feeder mechanism for feeding said waste materials in communication with a second opening defined in the wall of said reactor vessel processing chamber for the introduction of waste materials into said chamber, said second opening occurring in said wall at a height nearly co-level with the lower end of said top electrode.

5. An apparatus for plasma gasification of waste materials as claimed in claim 1, wherein said DC electrode system includes at least one top graphite electrode extending downwardly from a top end of said reactor vessel and a conductive plate defining a counter electrode formed as a portion of a bottom of said reactor vessel and being disposed opposite to said at least one electrode.

6. An apparatus for plasma gasification of waste materials as claimed in claim 5, wherein said feeder mechanism includes first and second feeder mechanisms disposed on opposite sides of said at least one top graphite electrode for feeding waste materials into said chamber through first and second openings formed on opposite sides of a circumferential side wall of said reactor vessel, said openings occurring in said wall at a height nearly co-level with the lower end of said at least one top graphite electrode.

7. An apparatus for plasma gasification of waste materials as claimed in claim 5, wherein said feeder mechanism includes first and second feeder mechanisms for feeding waste materials into said chamber by way of respective first and second openings formed adjacent to each other on a circumferential side wall of said reactor vessel, said openings occurring in said wall at a height nearly co-level with the lower end of said at least one top graphite electrode.

8. A method for plasma gasification of waste materials consisting of organic and inorganic portions comprising the steps of:

heating said waste materials in a refractory-lined reactor vessel having a processing chamber formed therein with a plasma arc generated by a DC electrode device so as to convert the organic portions of the waste materials to a synthetic gas consisting of hydrogen and carbon monoxide and to a carbon particulate, and to convert the inorganic portions of the waste materials to a molten material consisting of a lower metallic layer and a slag layer formed on top of the metallic layer, said DC electrode device having a top electrode extending from the top of said chamber such that a lower end of said top electrode is submerged below the surface of said slag layer, and a counter electrode located at the bottom of said chamber both said top and bottom electrodes are in direct contact with said molten material and said plasma arc occurs entirely within the molten material, and wherein an opening is defined in a wall of said reactor vessel processing chamber for the introduction of said waste materials into said chamber, said opening occurring in said wall at a height nearly co-level with a lower end of said top electrode;

withdrawing said synthetic gas from the processing chamber as an off-gas through a gas pipe formed with a refractory lining to maintain said off-gas at an effective temperature to substantially prevent the formation of complex organic components;

removing said molten material from said processing chamber;

monitoring the amount of carbon particulate entrained in the off-gas using a gas sampler monitor;

injecting an oxidant into said processing chamber in predetermined amounts so as to convert a majority of said carbon particulate into carbon monoxide;

regulating the amount of oxidant being injected into said processing chamber in response to the gas sampler monitor so as to minimize the formation of carbon particulate;

cooling rapidly the off-gas using a heat exchanger to a temperature of less than about 150 degrees C.; and separating the carbon particulate from the cooled off-gas to form a product clean gas.

9. A method for plasma gasification of waste materials as claimed in claim 8, wherein said chamber further includes a second opening defined in said wall and occurring in said wall at a height nearly co-level with the lower end of said top electrode.

10. An apparatus for plasma gasification of waste materials consisting of organic and inorganic portions comprising:

a refractory-lined reactor vessel having a processing chamber formed therein;

DC electrode system having top and bottom DC electrodes, said top electrode extending downwardly from the top of said chamber and said bottom electrode located on the bottom of said chamber, for generating a plasma arc and heating said processing chamber to a sufficient temperature so as to convert the organic portions of the waste materials to a synthetic gas consisting of hydrogen and carbon monoxide and to a carbon particulate, and to convert the inorganic portions of the waste materials to a molten material within said chamber consisting of a lower metallic layer and a slag layer formed on top of the metallic layer, wherein a lower end of said top electrode is submerged below the surface of said slag layer such that both said top and bottom electrodes are in direct contact with said molten material and said plasma arc occurs entirely within the molten material;

a feeder mechanism in communication with an opening defined in a wall of said reactor vessel processing chamber for the introduction of said waste materials into said chamber, said opening occurring in said wall at a height approximately co-equal to that of a lower end of said top electrode;

means for withdrawing said synthetic gas from the processing chamber as an off-gas;

gas pipe means formed with a refractory lining for maintaining said off-gas at an effective temperature to substantially prevent the formation of complex organic components;

means for removing said molten material from said processing chamber;

gas sampler monitoring means for monitoring the amount of carbon particulate entrained in the off-gas;

means for injecting an oxidant into said processing chamber in predetermined amounts so as to convert a majority of said carbon particulate into carbon monoxide;

control means responsive to said monitoring means for regulating the amount of oxidant being injected into said processing chamber so as to minimize the formation of carbon particulate; and means for cooling rapidly the off-gas to a temperature of less than about 150 degrees C. and for separating the carbon particulate from the cooled off-gas to form a product clean gas.

11. An apparatus for plasma gasification of waste materials as claimed in claim 10, wherein said DC electrode system includes a pair of spaced-apart top graphite electrodes and a conductive plate defining a counter electrode formed as a portion of a bottom of said reactor vessel and being disposed opposite to a corresponding one of said top electrodes.

12. An apparatus for plasma gasification of waste materials as claimed in claim 10, wherein said DC electrode system includes a pair of spaced-apart top graphite electrodes and a bottom of said reactor vessel being made of a conductive material so as to function as a counter electrode.

13. An apparatus for plasma gasification of waste materials as claimed in claim 10, further comprising a second feeder mechanism for feeding said waste materials in communication with a second opening defined in the wall of said reactor vessel processing chamber for the introduction of waste materials into said chamber, said second opening occurring in said wall at a height approximately co-equal to that of the lower end of said top electrode.

14. An apparatus for plasma gasification of waste materials as claimed in claim 10, wherein said DC electrode system includes at least one top graphite electrode extending downwardly from a top end of said reactor vessel and a conductive plate defining a counter electrode formed as a portion of a bottom of said reactor vessel and being disposed opposite to said at least one electrode.

15. An apparatus for plasma gasification of waste materials as claimed in claim 14, wherein said feeder mechanism includes first and second feeder mechanisms disposed on opposite sides of said at least one top graphite electrode for feeding waste materials into said chamber through first and second openings formed on opposite sides of a circumferential side wall of said reactor vessel, said openings occurring in said wall at a height proximal to the lower end of said at least one top graphite electrode.

16. An apparatus for plasma gasification of waste materials as claimed in claim 14, wherein said feeder mechanism includes first and second feeder mechanisms for feeding waste materials into said chamber by way of respective first and second openings formed adjacent to each other on a circumferential side wall of said reactor vessel, said openings occurring in said wall at a height approximately co-equal to that of the lower end of said at least one top graphite electrode.

* * * * *